US012661547B2

(12) United States Patent
Growald et al.

(10) Patent No.: US 12,661,547 B2
(45) Date of Patent: Jun. 23, 2026

(54) YOGA BLOCK

(71) Applicant: Present Materials Ltd, London (GB)

(72) Inventors: Lindsey Darwin Growald, Bainbridge Island, WA (US); Daniel S. Growald, Bainbridge Island, WA (US); Johann Boedecker, Berlin (DE); Lauren Greenwood, Berlin (DE); Volodymyr Nesin, London (GB)

(73) Assignee: Present Materials Ltd, London (GB)

( * ) Notice: Subject to any disclaimer, the term of this patent is extended or adjusted under 35 U.S.C. 154(b) by 1 day.

(21) Appl. No.: 18/660,224

(22) Filed: May 9, 2024

(65) Prior Publication Data

US 2024/0374954 A1 Nov. 14, 2024

Related U.S. Application Data

(60) Provisional application No. 63/465,401, filed on May 10, 2023.

(51) Int. Cl.
*A63B 21/00* (2006.01)
*A63B 23/00* (2006.01)

(52) U.S. Cl.
CPC .... *A63B 21/4039* (2015.10); *A63B 21/00047* (2013.01); *A63B 2023/006* (2013.01); *A63B 2209/18* (2020.08)

(58) Field of Classification Search
CPC ..... A63B 21/00047; A63B 21/4039; A63B 21/4037; A63B 2023/006; A63B 2209/18
See application file for complete search history.

(56) References Cited

U.S. PATENT DOCUMENTS

| | | | | |
|---|---|---|---|---|
| 3,581,431 | A | 6/1971 | Trenovan | |
| 4,021,983 | A * | 5/1977 | Kirk, Jr. | E04C 2/365 428/116 |
| D651,673 | S | 1/2012 | Kulzer | |
| D740,378 | S | 10/2015 | Walsh-Gomez | |
| D928,893 | S | 8/2021 | Razon | |

(Continued)

FOREIGN PATENT DOCUMENTS

| | | | |
|---|---|---|---|
| CN | 304515297 | S | 2/2018 |
| CN | 218306046 | U | 1/2023 |

(Continued)

OTHER PUBLICATIONS

PCT/US2024/028864 International Search Report and Written Opinion; Mailed Aug. 5, 2024; 12 pages.

(Continued)

*Primary Examiner* — Megan Anderson
(74) *Attorney, Agent, or Firm* — Lowe Graham Jones PLLC

(57) ABSTRACT

A yoga block includes a plurality of block panels defining a block outer surface substantially conforming to a cuboid shape with beveled or rounded edges and corners. An inner support interfaces with a plurality of inner surfaces of a portion of the plurality of block panels. The inner support includes a plurality of cross members oriented parallel and diagonally relative to sides of the cuboid shape. The plurality of block panels and the inner support are formed of a biodegradable or recycled material. The block outer surface may be treated with a biodegradable and hydrophobic material.

20 Claims, 9 Drawing Sheets

(56) References Cited

U.S. PATENT DOCUMENTS

| | | | | |
|---|---|---|---|---|
| 11,331,533 | B1 | 5/2022 | Razon | |
| 2004/0192523 | A1 | 9/2004 | Wu | |
| 2008/0254255 | A1* | 10/2008 | Kao | G06F 3/0395 428/141 |
| 2018/0304114 | A1 | 10/2018 | Feinstein | |
| 2021/0086021 | A1 | 3/2021 | Constanz et al. | |
| 2022/0379161 | A1 | 12/2022 | Reardon et al. | |

FOREIGN PATENT DOCUMENTS

| | | | |
|---|---|---|---|
| ES | 1273144 | U | 7/2021 |
| TW | M597156 | U | 6/2020 |
| TW | M606425 | U | 1/2021 |
| WO | 2021214581 | A1 | 10/2021 |

OTHER PUBLICATIONS

Ambena Inc; Advertisment for Eco Yoga Block; 4 pages.
Printables.com; Push Up or Yoga Block; Push Up or Yoga Block bu Digital-Twin; Printed May 9, 2024; 6 pages.

* cited by examiner

YOGA BLOCK

PRIORITY CLAIM

This application claims priority to U.S. Provisional Application Ser. No. 63/465,401 May 10, 2023, and entitled ECO-FRIENDLY CARDBOARD YOGA BLOCK WITH MODULAR STRUCTURE, which is hereby incorporated herein by reference in its entirety.

FIELD OF THE INVENTION

This application is related to yoga blocks. More specifically, it is related to eco-friendly yoga blocks.

BACKGROUND OF THE INVENTION

Yoga blocks are commonly used by yoga practitioners to support poses, assist balance, and improve alignment. Traditional yoga blocks are made of petrochemical-based foam, polyurethane-impregnated cork, or wood, which may not be environmentally friendly or sustainable.

SUMMARY OF THE INVENTION

In one aspect, a yoga block includes a block outer surface substantially conforming to a cuboid shape with edges and closed corners that are at least one of beveled or rounded to a depth of at least 0.1 times a smallest dimension of the cuboid shape. An inner support comprising a plurality of members is enclosed within the block outer surface.

The block outer surface may be formed of a material that is at least one of recycled, recyclable, bio-based, biodegradable, petrochemical free, and plastic free. The block outer surface is formed of at least one of (a) fibers bound together to form a sheet of material and (b) plastic that is at least one of recycled, bio-based, and biodegradable.

The block outer surface may be formed by a single folded sheet of material. In some embodiments, only one edge of the sheet of material is exposed. In some embodiments, the edges of the block outer surface include beveled edges and the block outer surface further include beveled corners. The single folded sheet of material may include corner panels forming the beveled corners, bevel panels forming the beveled edges, and flaps connected to the corner panels. The flaps may be connected to each corner panel and may be fastened to inner surfaces of an adjacent pair of bevel panels of the bevel panels with an outer surface of the each corner panel being substantially flush with outer surfaces of the adjacent pair of bevel panels forming part of the block outer surface, the outer surfaces of the adjacent pair of bevel panels being on an opposite side of the single folded sheet of material than the inner surfaces of the adjacent pair of bevel panels. The inner support may conform to inner surfaces of the beveled edges of the block outer surface.

The block outer surface may be formed of plates secured to the inner support. Each plate of the plates may include a plurality of layers. The inner support may be formed by sheets of material folded to form the plurality of members. The plurality of members may include a plurality of diagonal members that are diagonal with respect to the cuboid shape. Cylindrical members may be inserted within triangular spaces defined by the sheets of material. The inner support may be formed by interlocked cross pieces. The interlocked cross pieces may include diagonal cross pieces that are diagonal with respect to the cuboid shape.

The inner support may be formed by one or more honeycomb sandwich layers. One or more reinforcing plates are positioned between the inner support and the block outer surface. The block outer surface may include a treatment that is at least one of hydrophobic, grip-enhancing, or biodegradable. The cuboid shape may have a first dimension of between 4 and 12 inches in a first direction and a dimension of between 3 and 10 inches in a second direction perpendicular to the first direction.

In another aspect, a yoga block includes a plurality of block panels defining a block outer surface substantially conforming to a cuboid shape. Edges and closed corners of the block outer surface are beveled or rounded to a depth of at least 0.1 times a smallest dimension of the cuboid shape. An inner support interfaces with a plurality of inner surfaces of at least a portion of the plurality of block panels, the inner support including a plurality of cross members substantially parallel to sides of the cuboid shape. The inner support further includes a plurality of diagonal members oriented diagonally with respect to the sides of the cuboid shape and positioned within the block outer surface. The plurality of block panels and the inner support are formed of a material that is at least one of biodegradable or recycled. The block outer surface is treated with a biodegradable and hydrophobic material.

BRIEF DESCRIPTION OF THE DRAWINGS

Preferred and alternative examples of the present invention are described in detail below with reference to the following drawings.

DETAILED DESCRIPTION OF THE PREFERRED EMBODIMENTS

Figure 1:
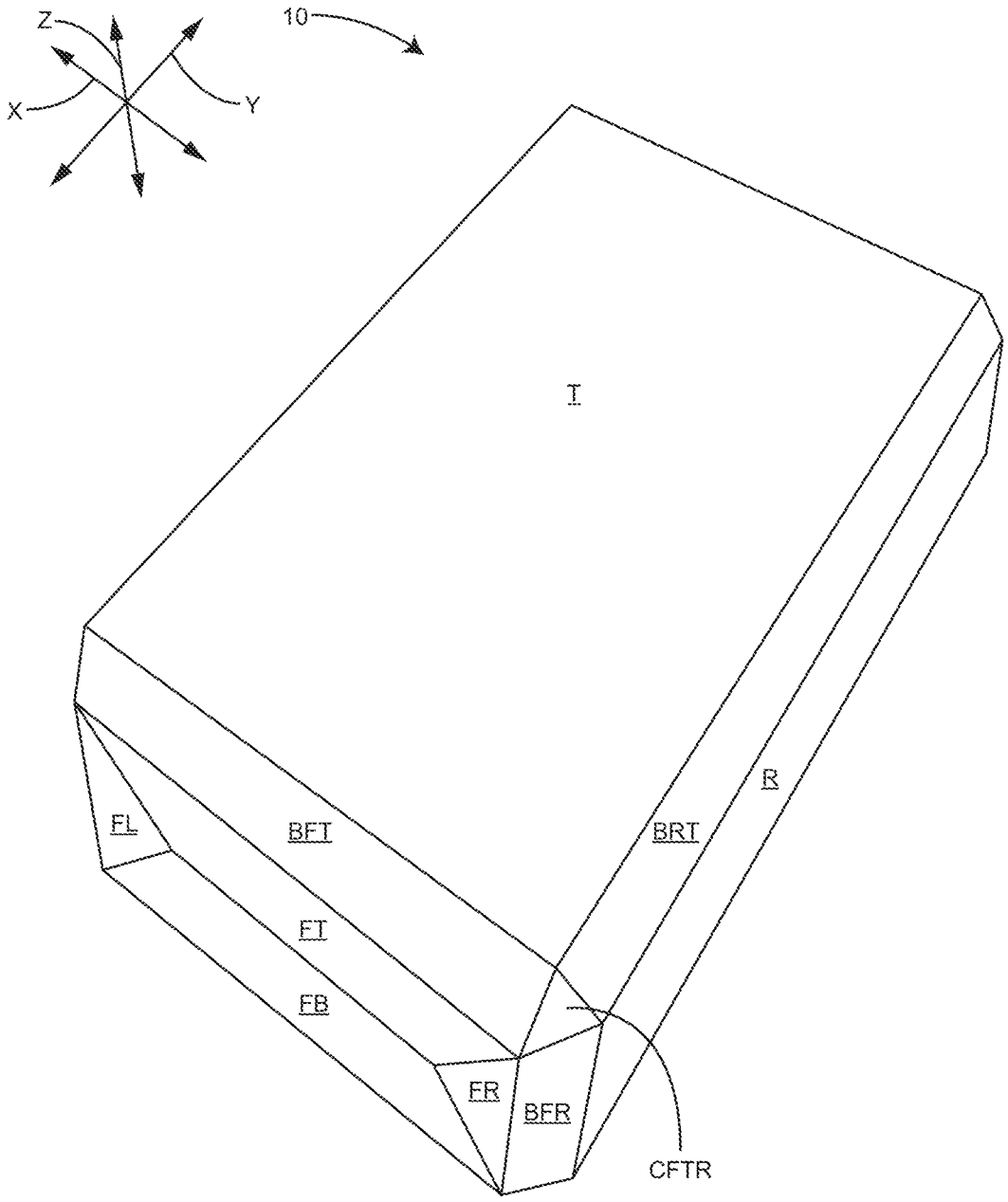
FIG. 1 is a perspective view of a yoga block in accordance with an embodiment of the present invention.
Figure 2:
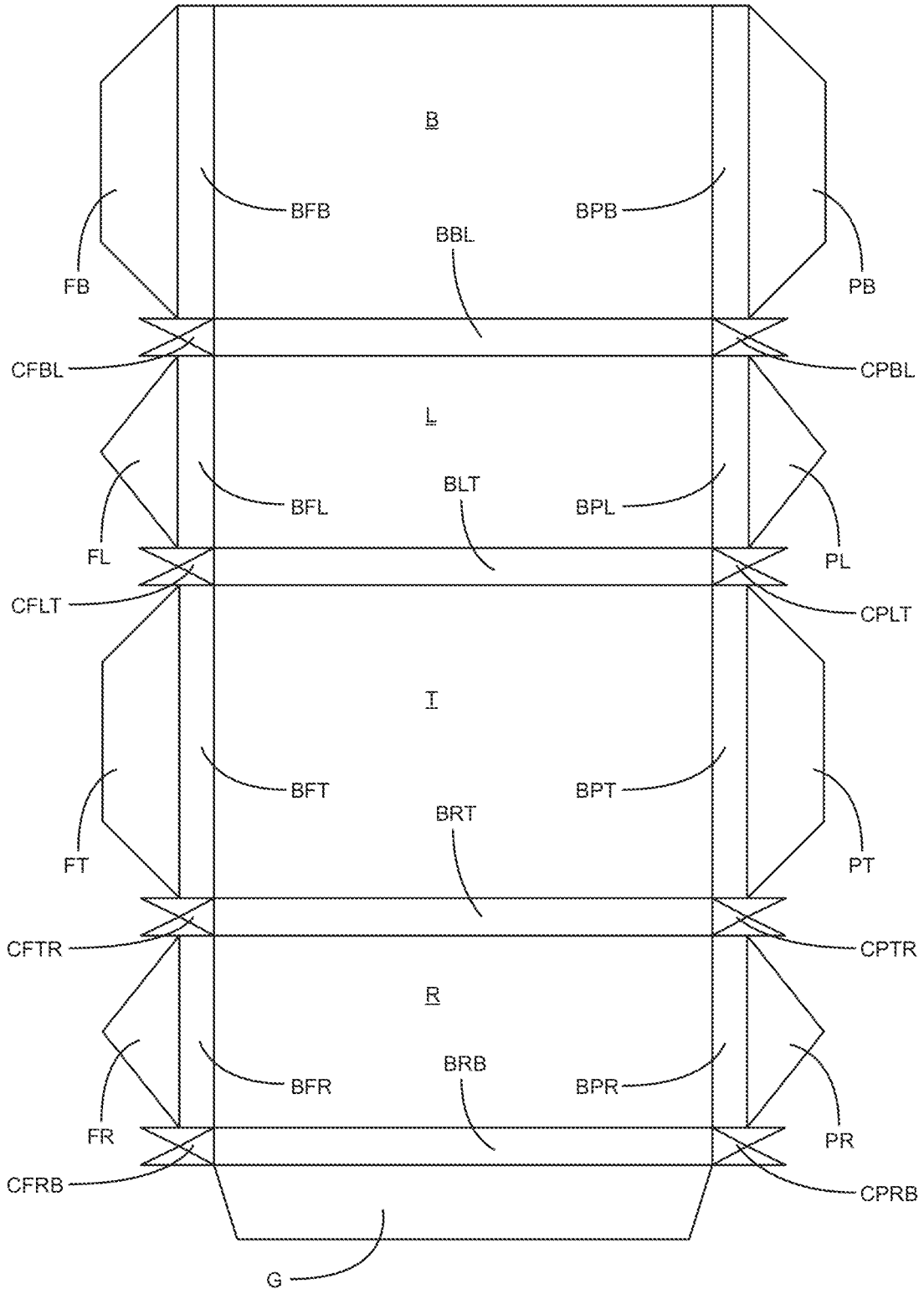
FIG. 2 is a top plan view showing an outline and fold lines of a piece of material that may be used to form the outer surface of a yoga block in accordance with an embodiment of the present invention.

Referring to FIGS. 1 and 2, a yoga block 10 may be understood with references to X, Y, and Z directions that are mutually perpendicular. The yoga block 10 is described below with relative positional terms (top, bottom, left, right, front, posterior) to facilitate understanding of the relative position of components of the yoga block 10 with the understanding that the actual orientation of the yoga block 10 may vary during use.

Yoga blocks 10, according to any of the embodiments disclosed herein, may have an outer shape that can be characterized as substantially cuboid including substantially cuboid-conforming surfaces connected by rounded or beveled edges and corners. As used herein, "substantially cuboid-conforming" may be defined as there being a cuboid shape such that each of the substantially cuboid-conforming surfaces of the yoga block is substantially parallel (e.g., within 10 degrees) to a surface of the cuboid shape and lies within 0.05*S from that surfaces, where S is the smallest dimension of the cuboid shape.

The dimensions of the outer surface of the yoga block 10 may be according to any size used in the practice of yoga. For example, the illustrated yoga block may have a length (Y direction) of about 4 to 12 inches, a width (X direction) of about 3 to 10 inches, and a height (Z direction) of about 1 to 6 inches. For example, common sizes for yoga blocks are about 9×6×4 inches and about 9×6×3 inches. As used herein, unless otherwise specified, "about" with reference to a value may be understood as within 10 percent of the value. Other sizes are possible. In particular, yoga blocks having different heights are commonly used. Beveled edges as described herein may extend inwardly from the cuboid shape between 0.1 and 0.25 times the shortest dimension of the cuboid shape along two of the directions X, Y, and Z, such as between 0.25 and 1 inches.

The yoga blocks 10 described herein are made of paper, paperboard, cardboard (e.g., corrugated), or other material made from wood pulp or paper pulp, or other random or woven or non-woven natural or synthetic fibers bound together to form a sheet of material. When corrugated, the corrugations may be oriented to provide desired structural properties, such as parallel to the X or the Y direction. The material used may advantageously be plastic or petrochemical free and recycled. The material used may advantageously also be biodegradable, including biodegradable plastic. In some embodiments, recycled plastic may be used, such as recycled ocean plastic.

Outer surfaces of the yoga blocks 10 disclosed herein may be treated to prevent disintegration of the material forming the yoga block 10. The treatment may include one or both of impregnating the material forming the yoga block 10 with a material and coating the outer surface of the material forming the yoga block with a coating. The treatment may additionally promote grip of the outer surfaces of the yoga block 10, particularly in the presence of moisture. The treatment may be waterproof and/or hydrophobic. The treatment may advantageously be biodegradable or petrochemical free. The treatment may include surface coatings, laser etching, embossing, debossing, and/or micro-embossing to improve grip. The surface of the yoga block 10 may be adorned with printing, debossing, embossing, laser etching, and/or die cuts either before or after treatment.

In a first example, the treatment may include a coating including a biomimetic hydrophobic coating modelled after the surface of the lotus leaf, such as OC-BIOBINDER made by ORGANOCLICK. For example, the coating may be a coating as described in the following document, which is hereby incorporated herein by reference in its entirety:

Ensikat H J, Ditsche-Kuru P, Neinhuis C, Barthlott W. Superhydrophobicity in perfection: the outstanding properties of the lotus leaf. Beilstein J Nanotechnol. 2011; 2:152-61. Doi: 10.3762/bjnano.2.19. Epub 2011 Mar. 10. PMID: 21977427; PMCID: PMC3148040.

In a second example, the coating is BIOBARC made by EARTHODIC.

The outer surface of the yoga block 10 may be made of panels either connected to one another or fastened to one another. As used herein "connected" may be understood as formed monolithically from a single sheet of material and "fastened" may be understood as secured by adhesive or other fastener. Adhesive may be polyvinyl acetate (PVA), a biodegradable bio-based glue, or other type of adhesive. The description of portions of the yoga block as being either connected or fastened are exemplary only and the opposite configuration is also possible.

FIGS. 1 and 2 illustrate a yoga block 10 having an outer surface formed of a single sheet of material. The yoga block 10 may have a top panel T, bottom panel B (FIG. 2), left panel L (FIG. 2), and a right panel R. The top panel T and bottom panel B are offset from one another in the Z direction and substantially conform to cuboid surfaces parallel to the X and Y directions. The right panel R and left panel L are offset from one another in the X direction and substantially conform to cuboid surfaces parallel to the Y and Z directions.

One or more flaps FT, FB, FL, and FR may form a front surface of the yoga block 10 and one or more flaps PT, PB, PL, and PR may form a posterior surface of the yoga block 10. The one or more flaps FT, FB, FL, and FR are offset from the one or more flaps PT, PB, PL, and PR along the Y direction. The one or more flaps FT, FB, FL, and FR and one or more flaps PT, PB, PL, and PR may substantially conform to cuboid surfaces parallel to the X and Z directions.

As is readily seen in FIG. 2, flap FT connects to a front edge of the top panel T, flap FB connects to a front edge of the bottom panel B, left flap FL is connected to a front edge of the left panel L, and right flap FR is connected to a front edge of the right panel R. Flap PT connects to a posterior edge of the top panel T, flap PB connects to a posterior edge of the bottom panel B, left flap PL is connected to a posterior edge of the left panel L, and right flap PR is connected to a posterior edge of the right panel R. The flaps FT, FB, FL, FR, PT, PB, PL, PR may connect to corresponding panels T, B, L, and R directly or by way of bevel panels as discussed below.

Beveled edges of the yoga block 10 may be formed by panels connected between substantially-cuboid conforming panels of the yoga block 10. For example:

- bevel panel BRT is connected to the right panel R and the top panel T
- bevel panel BLT is connected to the left panel L and the top panel T
- bevel panel BRB is connected to the right panel R and the bottom panel B
- bevel panel BLB is connected to the left panel L and the bottom panel B
- bevel panel BFT is connected to the top panel T and the flap FT
- bevel panel BFR is connected to the right panel R and the flap FR
- bevel panel BFL is connected to the left panel L and the flap FL
- bevel panel BFB is connected to the bottom panel B and the flap FB
- bevel panel BPT is connected to the top panel T and the flap PT
- bevel panel BPR is connected to the right panel R and the flap PR
- bevel panel BPL is connected to the left panel L and the flap PL bevel panel BPB is connected to the bottom panel B and the flap PB.

The yoga block 10 may likewise include beveled corners that may include (moving from top to bottom in FIG. 2):

- corner panel CFBL fastened to bevel panels BFB, BFL and connected to bevel panel BBL
- corner panel CPBL fastened to bevel panels BPB, BPL and connected to bevel panel BBL
- corner panel CFLT fastened to bevel panels BFL BFT and connected to bevel panel BLT
- corner panel CPLT fastened to bevel panels PFL, PFT and connected to bevel panel BLT
- corner panel CFTR fastened to bevel panels BFT, BFR and connected to bevel panel BRT
- corner panel CPTR fastened to bevel panels BPT, BPR and connected to bevel panel BRT
- corner panel CFRB fastened to bevel panels BFR, BFB and connected to bevel panel BRB
- corner panel CPRB fastened to bevel panels flaps BPR, BPB and connected to bevel panel BRB.

As is apparent in FIG. 2, the panels of the yoga block 10 may initially be cut from a single piece of material that is then folded and fastened to form the yoga block 10. In the illustrated embodiment, a flap G is connected to bevel panel BRB and may be fastened to the inner surface of bottom panel B, such as by adhesive, staples, rivets, or other fastener. Using the flap G, only one edge of the single sheet of material is exposed: the edge of the bottom panel B that is parallel to the Y direction and adjoins bevel panel BRB (the top edge in FIG. 2).

Figure 3A:
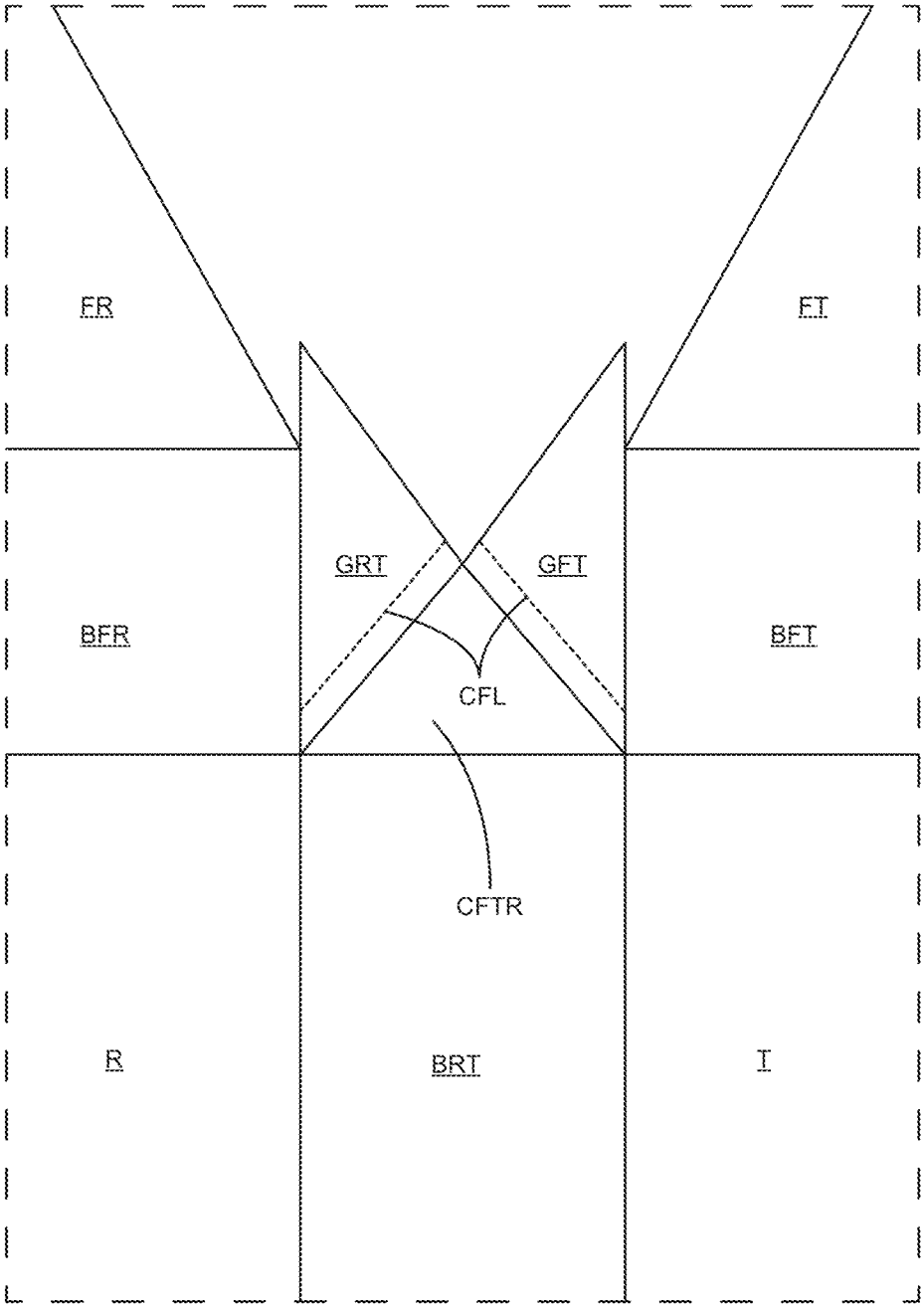
FIG. 3A is a partial top plan view showing segments for forming a corner of a yoga block in accordance with an embodiment of the present invention.
Figure 3B:
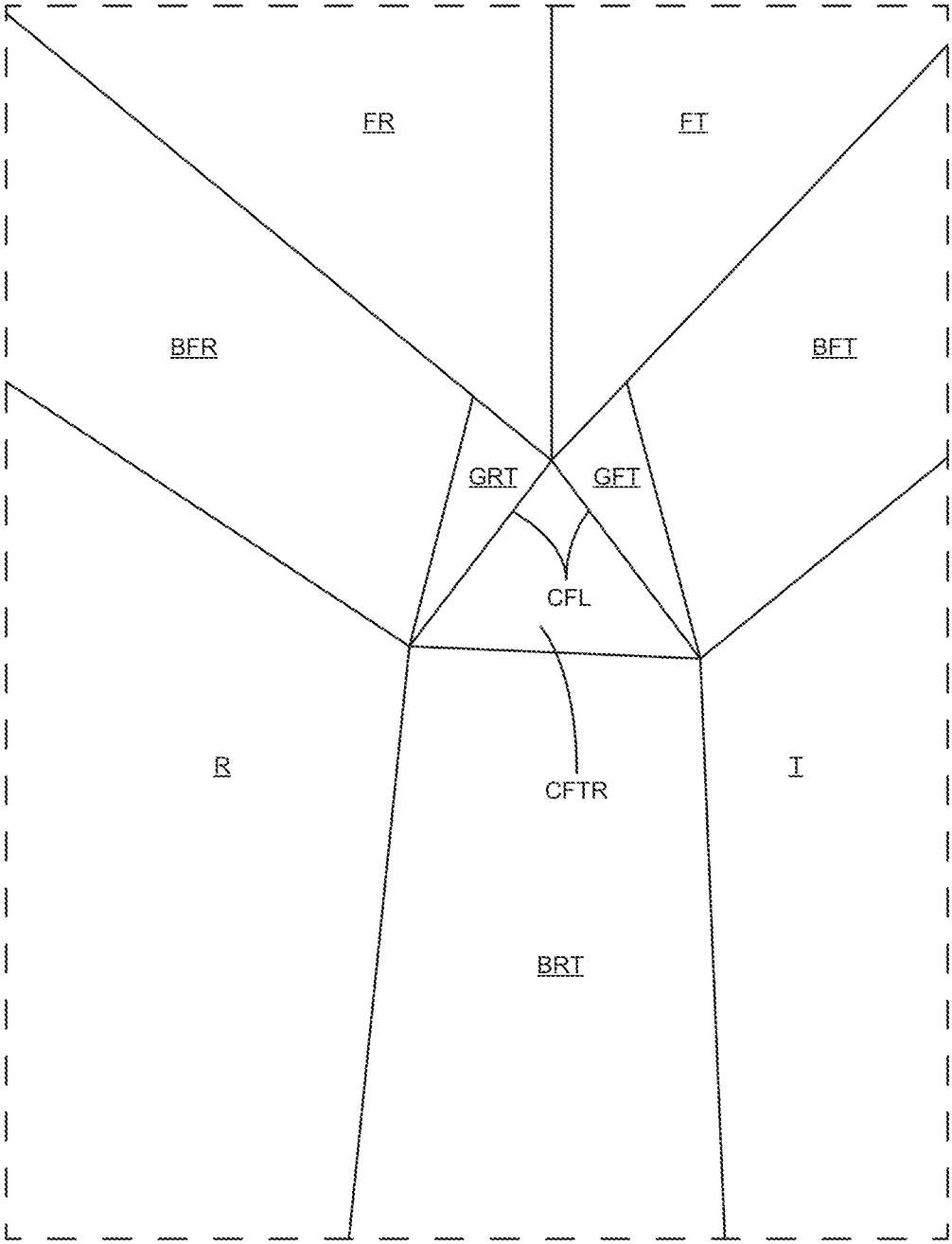
FIG. 3B is an internal isometric view of a corner of a yoga block in accordance with an embodiment of the present invention.

FIGS. 3A and 3B illustrate the fastening of corner panels of the yoga block 10. In particular, FIGS. 3A and 3B illustrate one approach for forming closed corners extending between the beveled edges of the yoga block. Closed corners may also be achieved using the approach shown in FIGS. 7A and 7B. The fastening of corner panel CFTR is shown with other corners being secured in a like manner. The corner panel CFTR may include flaps GRT and GFT secured to edges thereof. Referring specifically to FIG. 3A, the corner panel CFTR may have a triangle shape with one leg connected to the bevel panel BRT, one leg connected to flap GRT and one flap connected to flap GFT. The flaps GRT, GFT may be folded along fold lines CFL prior to fastening. The separation between the fold lines CFL and the center panel CFTR may be approximately equal to (e.g., within 10% of) a thickness of the material forming the bevel panels BFR, BFT.

Referring to FIG. 3B, the flaps GRT, GFT may be fastened to the bevel panels BFR, BFT, respectively, using adhesive or other fastener. The portion of the flaps GRT, GFT between the center panel CFTR and the fold lines CFL may interface with edges of the bevel panels BFR, BFT such that the outer surface of the center panel CFTR is substantially flush with outer edges of the bevel panels BFR, BFT, BRT, right panel R, and top panel T, as shown in FIG. 1. As used herein "substantially flush" may be understood as within 0.1*Th of flush, where Th is the average thickness of the sheet of material from which the yoga block is formed.

Figure 4:
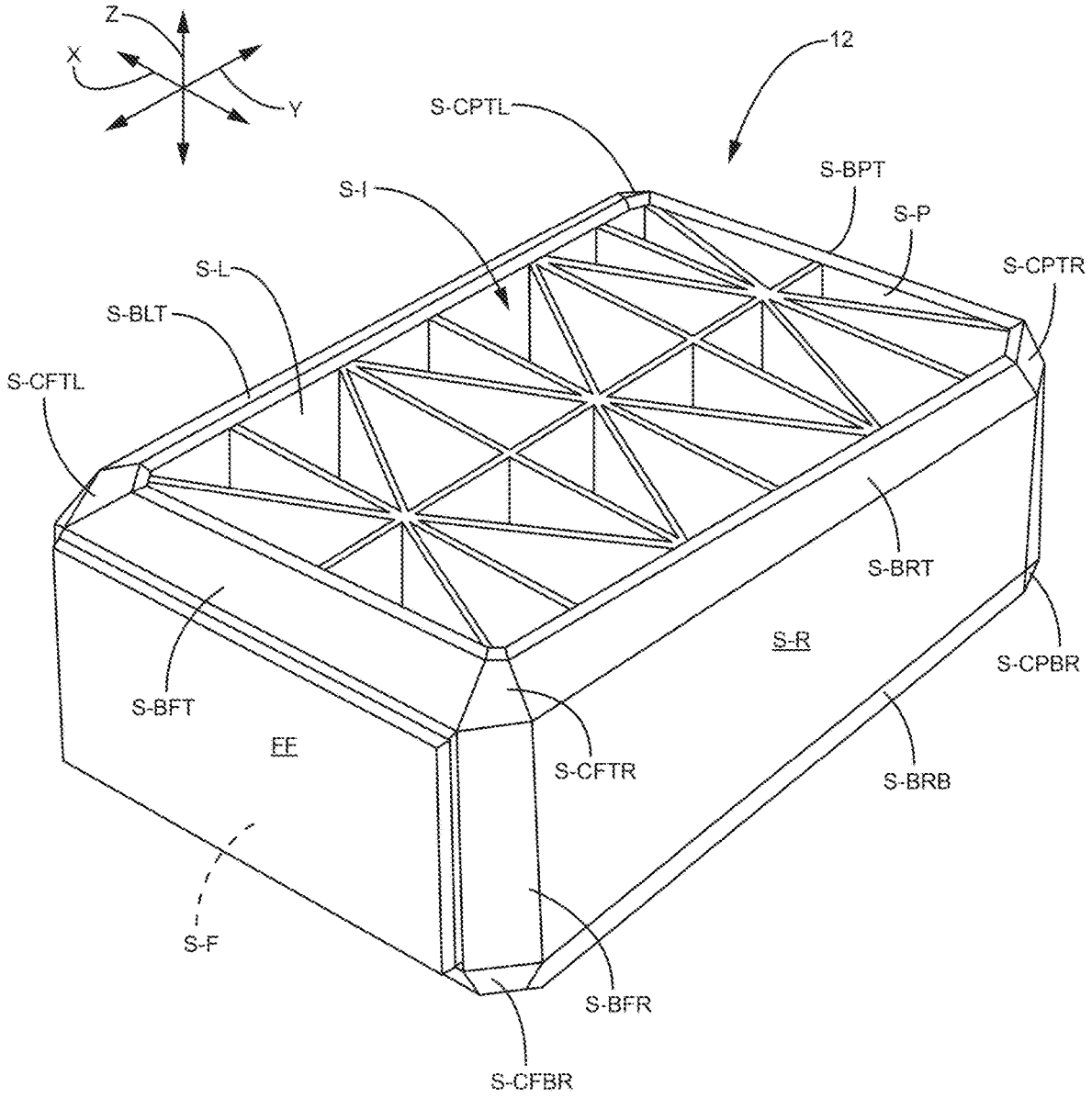
FIG. 4 is an isometric view of an internal support of a yoga block in accordance with an embodiment of the present invention.
Figure 5A:
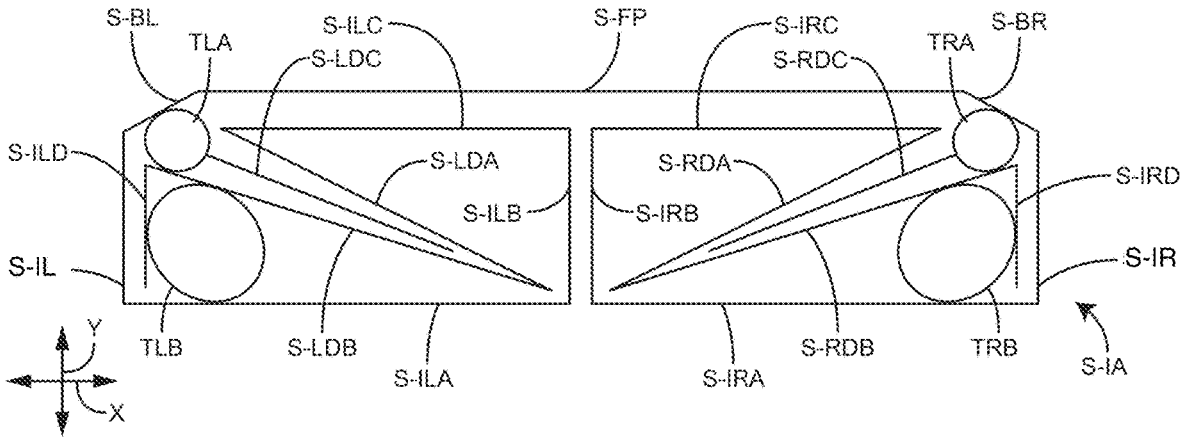
FIGS. 5A and 5B illustrate folding of material to form the internal support for a yoga block in accordance with an embodiment of the present invention.
Figure 5B:
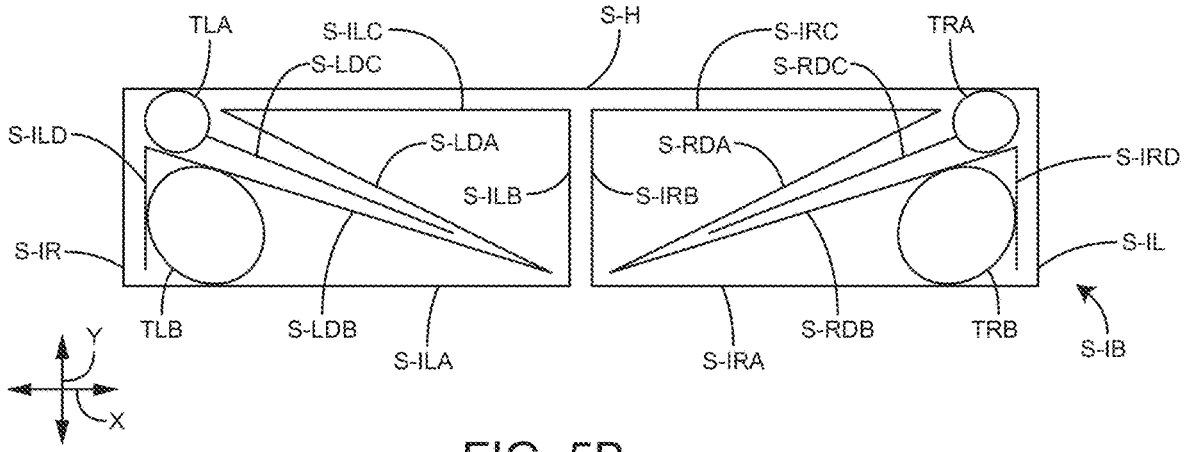

FIG. 4 illustrates an example internal support 12 for the yoga block 10. The internal support may include surfaces interfacing with inner surfaces of the panels of the yoga block 10. The illustrated internal support 12 may be made of multiple individual segments stacked together inside the outer surface. Examples of these segments are shown in FIGS. 5A and 5B and corresponding discussion below. For example, for each panel other than panel T and panel B, there may be a corresponding panel of the internal support 12 interfacing therewith. Considering those panels visible in the view of FIG. 4, the internal support 12 may include:

- panel S-R interfacing with panel R (see also FIGS. 1 and 2)
- panel S-L interfacing with panel L (see also FIG. 2)
- panel S-BLT interfacing with bevel panel BLT (see also FIG. 2)
- panel S-BRT interfacing with bevel panel BRT (see also FIGS. 1 and 2)
- panel S-BRB interfacing with bevel panel BRB (see also FIG. 2)
- panel S-BFT interfacing with bevel panel BFT (see also FIGS. 1 and 2)
- panel S-BPT interfacing with bevel panel BPT (see also FIG. 2)
- corner panel S-CFTL interfacing with corner panel CFTL (see also FIG. 2)
- corner panel S-CFTR interfacing with corner panel CFTR (see also FIGS. 1 and 2)
- corner panel S-CFBR interfacing with corner panel CFBR (see also FIG. 2)
- corner panel S-PCTL interfacing with corner panel CPTL (see also FIG. 2)
- corner panel S-CPTR interfacing with corner panel CPTR (see also FIG. 2)
- corner panel S-CPBR interfacing with corner panel CPBR (see also FIG. 2)

The flaps FT, FB, FL, FR may either adhere directly to a panel of the internal support 12 or to one or more reinforcement panels FF placed between the internal support 12 and the flaps FT, FB, FL, FR. For example, the internal support 12 may include a panel S-F connected to the panels S-R and a panel S-L. One or more reinforcement panels FF secure to the panel S-F and the flaps FT, FB, FL, FR are secured to an outermost panel FF by adhesive, staples, rivets, or other fastener. Where multiple reinforcement panels FF are used, the reinforcement panels may be secured to one another by adhesive, staples, rivets, or other fastener. The reinforcement panels FF may have substantially a same size as the panel S-F, such as within 5% within each dimension along the X and Z directions. The posterior flaps PT, PB, PL, PR may secure to a panel S-P opposite the panel S-F along the Y direction using corresponding reinforcement panels in the same manner as for the reinforcement panels FF.

The panels of the internal support 12 interfacing with bevel panels and corner panels of the yoga block 10 may be connected to panels S-R, S-L, S-F, and S-P of the internal support 12 and folded inward to conform to the bevel panels and corner panels. However, other arrangements are also possible.

The internal support 12 may include cross members S-I to resist deformation of the internal support. The cross members S-I may be beveled to conform to the panels of the internal support 12 interfacing with the bevel panels and possibly corner panels of the yoga block 10.

Referring to FIGS. 5A and 5B, the cross members S-I may be formed of one or more instances of cross members S-IA and S-IB. For examples, at least two instances of the cross members S-IA may be used in a mirrored configuration to conform to bevel panels BFL, BPL, BFR, BPR. Zero or more instances of cross members S-IB may be positioned between the two instances of the cross members S-IA.

Each cross member S-IA, S-IB may include a panel S-FP interfacing with, or serving as, the panel S-F or S-P of the internal support 12. Each cross member S-IA may include panels S-IR and S-IL interfacing with, or forming part of, the panels S-R and S-L, respectively, of the internal support 12.

The cross members S-IA may include bevel panels S-BL, S-BR that interface with, or serve as, panels of the internal support 12 interfacing with bevel panels BFL, BFR or bevel panels BPL, BPR. The bevel panel S-BL may be connected to panels S-L and S-FP and the bevel panel S-BR may be connected to panels S-R and S-FP.

Each cross member S-IA, S-IB may include a set of internal panels S-ILA, S-ILB, S-ILC, and S-ILD and a set of internal panels S-IRA, S-IRB, S-IRC, and S-IRD that are curled inwardly. In the illustrated embodiment, internal panels S-ILA, S-ILC, S-IRA, and S-IRC are substantially (e.g., within 3 degrees of) parallel to the X and Z directions and internal panels S-ILB, S-ILD, S-IRB, S-IRD are substantially parallel to the Y and Z directions.

Each cross member S-IA, S-IB may include one or more diagonal panels or the illustrated diagonal panels may be omitted. For example, diagonal panels S-LDA, S-LDB may be connected to internal panels S-ILC, S-ILD, respectively, and to one another. The diagonal panels S-LDA, S-LDB may extend to, and possibly contact, a corner formed by internal panels S-ILA, S-ILB. Diagonal panels S-RDA, S-RDB may be connected to internal panels S-IRC, S-IRD, respectively, and to one another. The diagonal panels S-RDA, S-RDB may extend to, and possibly contact, a corner formed by internal panels S-IRA, S-IRB. As used herein "diagonal" refers to a planar member with surfaces (i.e., not the edges parallel to the thinnest dimension corresponding to the thickness of the planar member) that are oriented at an angle of between 30 and 60 degrees relative to at least one of the X-Y, X-Z, and Y-Z planes.

In some embodiments, each cross member S-IA, S-IB may be further reinforced by cylindrical members TLA, TLB, TRA, TRB. In some embodiments, cylindrical members TLA, TLB, TRA, TRB are cylindrical absent a deforming force but may be elastically distorted when assembled with the cross member S-IA.

A cylindrical member TLA may be placed at an interior corner defined by the panels S-FP and S-IL (and a corresponding bevel panel S-BL for cross member S-IA). One, two, or more insert panels S-LDC may be positioned between the diagonal panels S-LDA, S-LDB and facilitate holding the cylindrical member TLA in place or may be used without the cylindrical member TLA. A cylindrical member TLB may be placed in a triangular area defined by panels S-ILA, S-ILD, and diagonal panel S-LDB. In some embodiments, an additional cylindrical member is placed In the triangular area defined by panels S-ILC, S-ILB and diagonal panel S-LDA. Central axes of the cylindrical members may be substantially (e.g., within 5 degrees of) parallel to the Z direction.

A cylindrical member TRA may be placed at an interior corner defined by the panels S-FP and S-IR (and a corresponding bevel panel S-BR for cross member S-IA). One, two, or more insert panels S-RDC may be positioned between the diagonal panels S-RDA, S-RDB and facilitate holding the cylindrical member TRA in place or may be used without the cylindrical member TRA. A cylindrical member TRB may be placed in a triangular area defined by panels S-IRA, S-IRD, and diagonal panel S-RDB. In some embodiments, an additional cylindrical member is placed in the triangular area defined by panels S-IRC, S-IRB and diagonal panel S-RDA.

In some embodiments, two pairs of insert panels S-LDC, S-RDC are used in S-IA (see FIG. 5A) whereas a single insert set of insert panels S-LDC, S-RDC are used in S-IB (see FIG. 5B).

Figure 6A:
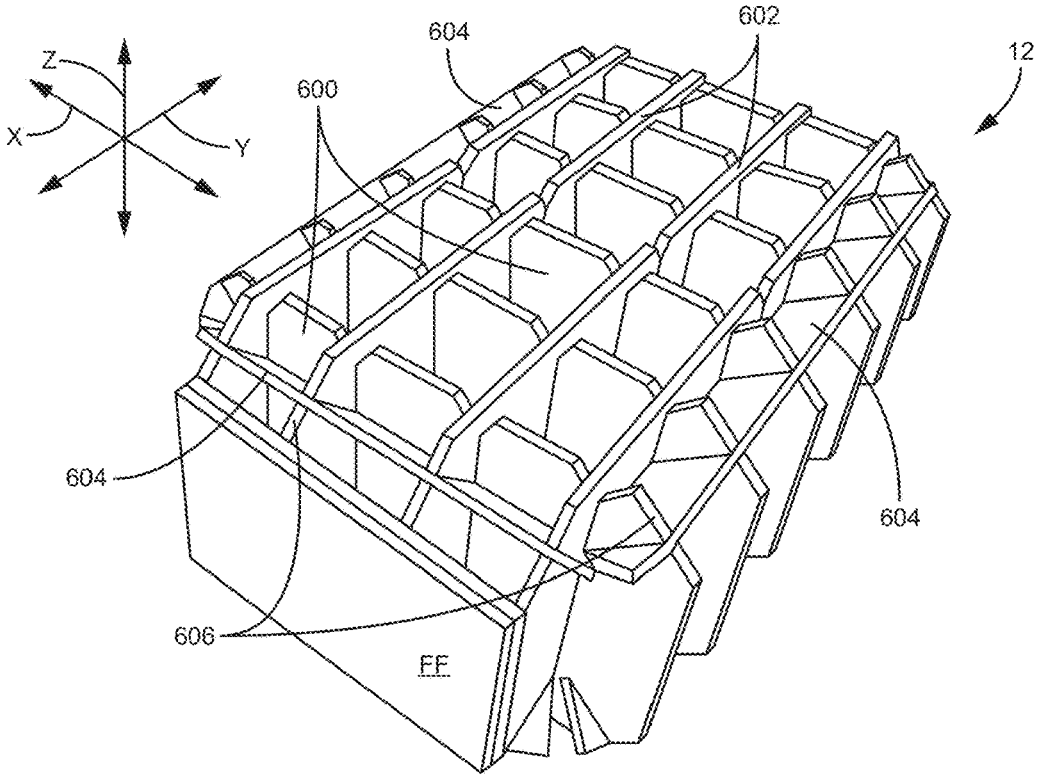
FIGS. 6A and 6B are perspective views of alternative internal supports for a yoga block in accordance with an embodiment of the present invention.
Figure 6B:
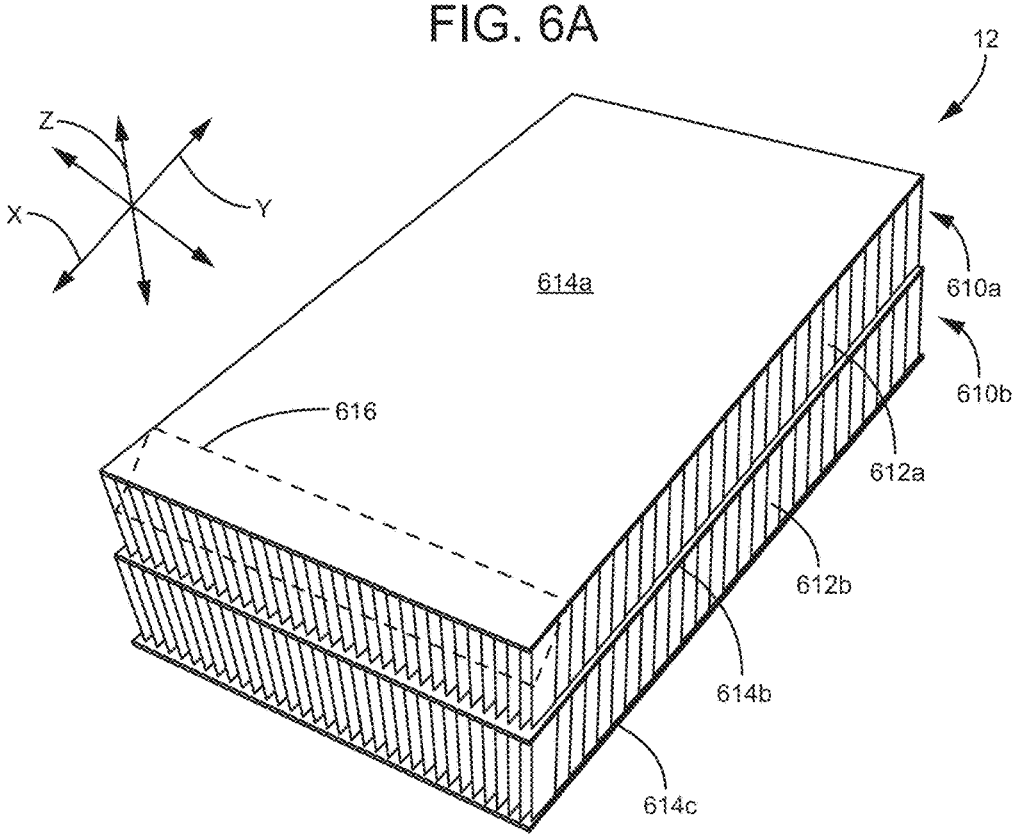

FIGS. 6A and 6B illustrate alternative embodiments for internal supports 12 for the yoga block 10. Referring specifically to FIG. 6A, an internal support 12 may be formed of horizontal members 600 embodied as planar members oriented substantially (e.g., within 5 degrees of) parallel to the X and Z directions and longitudinal members 602 oriented substantially (e.g., within 5 degrees of) parallel to the Y and Z directions. The horizontal members 600 may be interlocked with the longitudinal members 602, such as by positioning the horizontal members 600 within slits formed in the longitudinal members 602 and by positioning the longitudinal members 602 within slits formed in the horizontal members 600. In some embodiments, diagonal members 604 are interlocked with the horizontal members 600 and/or longitudinal members 602. For example, the horizontal members 600 and/or longitudinal members 602 may include bevels 606 cut to conform to the bevel panels of the yoga block 10. The diagonal members 604 may seat within slits extending inwardly from the bevels 606. The diagonal members 604 may likewise define slits for receiving the horizontal members 600 and/or longitudinal members 602.

The diagonal members 604 engaging the horizontal members 600 may be planar members oriented substantially (e.g., within 5 degrees of) parallel to the X direction and at an angle of between 35 and 55 degrees relative to the Z direction in the Y-Z plane. The diagonal members 604 engaging the longitudinal members 602 may be planar members oriented substantially (e.g., within 5 degrees of) parallel to the Y direction and at an angle of between 30 and 60 degrees relative to the Z direction in the X-Z plane.

Reinforcement plates FF may secure to one or both of the horizontal members 600 and/or longitudinal members 602. For example, the reinforcement plates may be substantially (e.g., within 5 degrees of) parallel to the X and Z directions and secure to edges of the longitudinal members 602 that are also substantially (e.g., within 5 degrees of) parallel to the X and Z directions.

Referring to FIG. 6B, in some embodiments, the inner support 12 is implemented using one or more layers 610*a*, 610*b* of honeycomb sandwich material. For example, planar layers 614*a*, 614*b*, 614*c* may be oriented substantially (e.g., within 2 degrees of) parallel to the X and Y directions. Honeycomb layers 612*a*, 612*b* may be positioned between pairs of the planar layers 614*a*, 614*b*, 614*c*. The honeycomb layers 612*a*, 612*b* layers may be made of material forming hexagonal or other shapes in the X-Y plane. Corners of the layers 610*a*, 610*b* may be cut along a plurality of section planes 616 to conform to inner surfaces of the bevel panels of the yoga block 10. The inner surfaces of the yoga block 10 may be adhered to the layers 610*a*, 610*b* using adhesive or other fasteners. The layers 610*a*, 610*b* may be used with reinforcement plates FF in the same manner as for other embodiments disclosed herein.

Figure 7A:
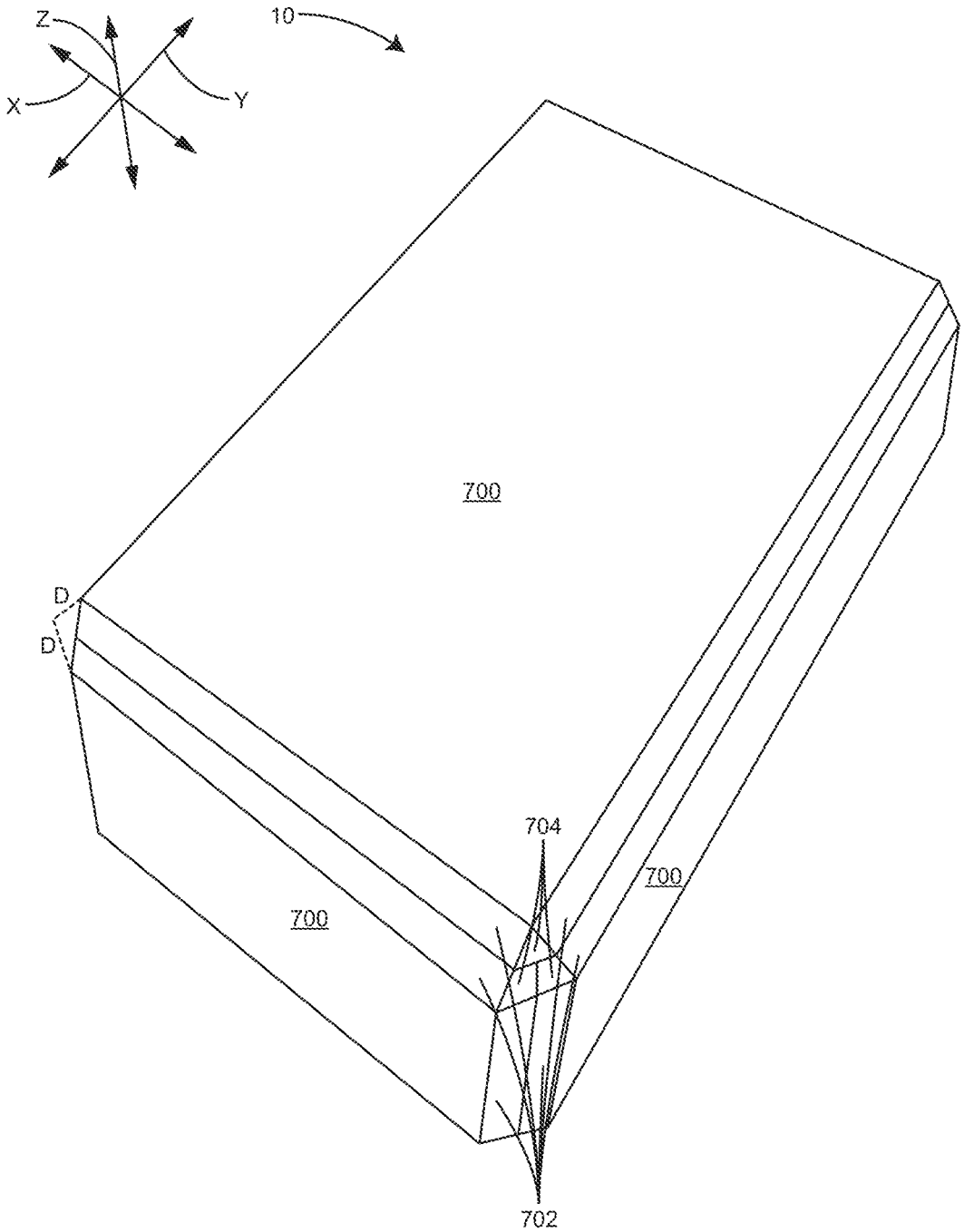
FIG. 7A illustrates an alternative embodiment of a yoga block in accordance with an embodiment of the present invention.
Figure 7B:
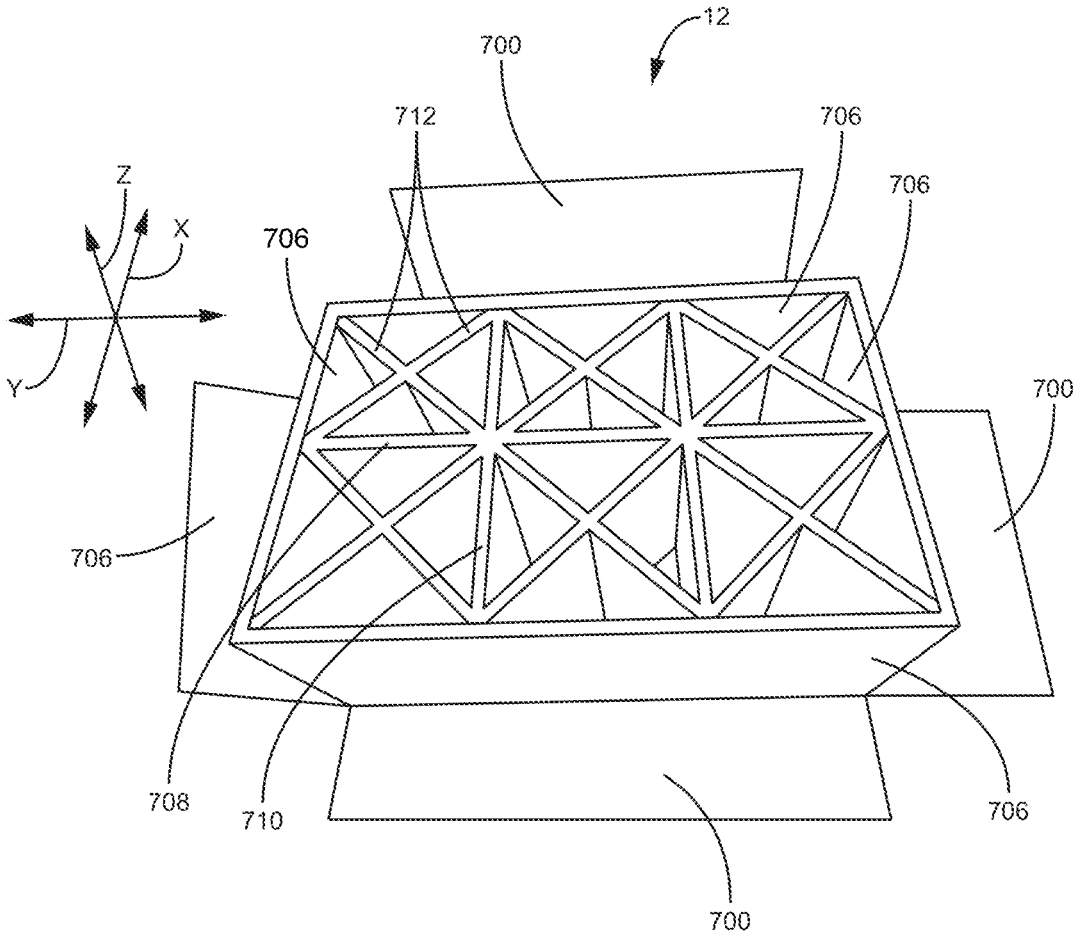
FIG. 7B illustrates an internal support for the yoga block of FIG. 7A in accordance with an embodiment of the present invention.

Referring to FIGS. 7A and 7B, in some embodiments, a yoga block 10 may be formed of thick plates 700 of paper, paperboard, cardboard, fiber board, or other material. The yoga block 10 may have a substantially cuboid shape as defined above. Edges 702 and corners 704 of the plates 700 may be rounded and/or beveled to form a substantially cuboid shape with beveled or rounded edges and corners as described above with respect to the yoga block 10 of FIG. 1. In this and other embodiments, bevels may be present with rounding at corners of the bevels. The plate 700 may be made of one layer or multiple layers that are manufactured together or secured to one another using compression or adhesive or other fastener. The plates 700 may have a thickness of between 0.75 and 1 inches, between 0.1 and 0.75 inches, or between 0.2 and 0.5 inches, such as about 0.25 inches. The beveled edges 702 and corners 704 of the plates 700 may be formed either before or after the plates 700 are assembled together.

Each plate 700 includes a substantially cuboid-conforming surface relative to a cuboid shape, the substantially cuboid-conforming surface being substantially parallel to two directions of the directions X, Y, Z as defined above with respect to the term "substantially cuboid-conforming." The bevels on edges 702 and corners 704 of each plate 700 may all extend inwardly at least a distance D in two of the dimensions X, Y, Z relative to the cuboid shape. The cuboid-conforming surface and beveled edges 702 and corners 704 may form a truncated rectangular pyramid with beveled corners. The thickness of each plate 700 in the third direction of the directions X, Y, Z may be may be about D/2, e.g., D/2+/−5%.

Note that the seam between adjacent plates 700 (e.g., forming a common edge 702) does not have to be in the center of the beveled edges 702 to achieve this overall shape using six plates. For instance, the same overall external shape of the yoga block 10 may be achieved with different plate shapes: e.g., all four of the beveled edges 702 and all four beveled corners 704 around the perimeter of a plate 700 could be completely formed by that plate 700 (e.g., a plate 700 formed as a truncated pyramid with beveled corners). Adjacent plates 700 to that plate 700 may then be rectangular. For example, first and second plates 700 that are opposite one another may have the beveled edges 702 and beveled corners 704 formed thereon with remaining plates extending therebetween each being in the shape of a truncated prism with two vertical edges and two beveled edges that do not form part of the beveled corners 704.

Referring specifically to FIG. 7B, the plates 700 may secure to an inner support 12 according to any of the embodiments disclosed herein (note that the top plate shown in FIG. 7A is omitted from FIG. 7B to enable visualization of the inner support). FIG. 7B illustrates yet another example internal support 12 that may be used with the plates 700. The inner support 12 may include sides 706 fastened to, or connected to, one another to form a rectangular tube. For example, the sides 706 may include two sides 706 substantially (e.g., within 5 degrees of) parallel to the X and Z direction and offset from one another in the Y direction and two sides 706 substantially (e.g., within 5 degrees of) parallel to the Y and Z direction and offset from one another in the X direction. Each side 706 may include one, two, or more layers. For example, the sides 706 may be formed by two rectangular tubes, one nested inside the other.

Various cross members may be positioned within the space defined by the sides 706. For example, the cross member may include longitudinal cross members 708 substantially (e.g., within 5 degrees of) parallel to the X and Z direction and distributed along the Y direction. The cross member may include horizontal cross members 710 substantially (e.g., within 5 degrees of) parallel to the Y and Z direction and distributed along the X direction. The cross members may include diagonal cross members 712 positioned in spaces defined among the sides 706 and cross members 708, 712. For example, the diagonal cross members may be substantially parallel to the Z directions and along diagonal lines extending between opposite corners (not connected by a common side) of a quadrilateral shape defined by a side 706, a longitudinal cross member 708, and a horizontal cross member 710. The inner support 12 of FIG. 7B may be formed by placing pieces together to achieve the illustrated configuration. The members 708, 710, 712 may be held in place by the sides 706 without use of additional fasteners or adhesive or may be fastened to each other and the sides 706. The sides 706 and members 708, 710, 712 may be secured to one another by co-formation (e.g., molding), or other manufacturing process.

The plates 700 may be secured to the inner support 12 by adhesive or other fastener. The plates 700 having the substantially cuboid-conforming surface thereof substantially parallel to the X and Y directions may secure to edges of the sides 706, longitudinal cross members 708, and horizontal cross members 710. The plates 700 having the substantially cuboid-conforming surface thereof substantially parallel to the Z direction may be secured to surfaces of the sides 706 that are substantially parallel to the Z direction.

While the preferred embodiments of the invention have been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The invention claimed is:

1. A yoga block comprising:

a block outer surface substantially conforming to a cuboid shape; and an inner support enclosed within the block outer surface, the inner support including a plurality of cross pieces, the plurality of cross pieces formed from sheets of material, the plurality of cross pieces including:

a first set of sheets oriented in a first diagonal direction relative to front, posterior, left, and right surfaces of the block outer surface; and a second set of sheets oriented in a second diagonal direction relative to the front, posterior, left, and right surfaces of the block outer surface, the second diagonal direction being different from the first diagonal direction;

wherein the plurality of cross pieces forms a repeating pattern of triangular cross-sectional spaces extending between an upper surface and a lower surface of the block outer surface.

2. The yoga block of claim 1, wherein the block outer surface is formed by a single folded sheet of material.

3. The yoga block of claim 2, wherein only one edge of the single folded sheet of material is exposed.

4. The yoga block of claim 3, wherein edges of the block outer surface include beveled edges.

5. The yoga block of claim 4, wherein the inner support conforms to inner surfaces of the beveled edges of the block outer surface.

6. The yoga block of claim 2, wherein the single folded sheet of material is fastened with a biodegradable bio-based glue.

7. The yoga block of claim 1, wherein the block outer surface is formed of plates secured to the inner support.

8. The yoga block of claim 7, wherein each plate of the plates comprises a plurality of layers.

9. The yoga block of claim 1, wherein the plurality of cross pieces are interlocked.

10. The yoga block of claim 9, wherein the plurality of cross pieces includes a third set of sheets extending completely across between panels defining the left and right surfaces of the block outer surface and offset from panels defining the front and posterior surfaces and substantially parallel to the front and posterior surfaces.

11. The yoga block of claim 1, wherein the block outer surface includes a treatment that is at least one of hydrophobic, grip-enhancing, or biodegradable.

12. The yoga block of claim 11, wherein the treatment is a biomimetic hydrophobic treatment.

13. The yoga block of claim 1, wherein the block outer surface is formed of a material that is at least one of recycled, recyclable, bio-based, biodegradable, petrochemical free, and plastic free.

14. The yoga block of claim 1, wherein the block outer surface is formed of at least one of (a) fibers bound together to form a sheet of material and (b) plastic that is at least one of recycled, bio-based, and biodegradable.

15. The yoga block of claim 1, further comprising cylindrical members inserted within the triangular cross-sectional spaces defined by the plurality of cross pieces.

16. The yoga block of claim 1, further comprising one or more reinforcing plates positioned between the inner support and the block outer surface.

17. The yoga block of claim 1, wherein the cuboid shape has a first dimension of between 4 and 12 inches in a first direction and a second dimension of between 3 and 10 inches in a second direction perpendicular to the first direction.

18. The yoga block of claim 1, wherein:

the plurality of cross pieces includes a third set of sheets extending completely across between panels defining the left and right surfaces of the block outer surface and offset from panels defining the front and posterior surfaces and substantially parallel to the front and posterior surfaces; and each sheet of material of the sheets of material is folded and includes a sheet from the first set of sheets, a sheet from the second set of sheets, a sheet from the third set of sheets, and sheets substantially parallel to the left and right surfaces.

19. A yoga block comprising:

a block outer surface substantially conforming to a cuboid shape with edges and closed corners that are at least one of beveled or rounded to a depth of at least 0.1 times a smallest dimension of the cuboid shape; and an inner support comprising a plurality of members enclosed within the block outer surface;

wherein:

the block outer surface is formed by a single folded sheet of material;

only one edge of the single folded sheet of material is exposed;

the edges of the block outer surface include beveled edges and the block outer surface further includes beveled corners;

the single folded sheet of material includes corner panels forming the beveled corners and bevel panels forming the beveled edges, and flaps connected to the corner panels; and the flaps connected to each corner panel are fastened to inner surfaces of an adjacent pair of bevel panels of the bevel panels with an outer surface of the each corner panel being substantially flush with outer surfaces of the adjacent pair of bevel panels forming part of the block outer surface, the outer surfaces of the adjacent pair of bevel panels being on an opposite side of the single folded sheet of material than the inner surfaces of the adjacent pair of bevel panels.

20. A yoga block comprising:

a block outer surface substantially conforming to a cuboid shape;

an inner support enclosed within the block outer surface, the inner support formed by a plurality of cross pieces of sheet material, the plurality of cross pieces including a plurality of diagonal cross pieces that are diagonal relative to front, posterior, left, and right surfaces of the block outer surface, the plurality of cross pieces defining a plurality of triangular spaces, one side of each triangular space being defined by a respective diagonal cross piece of the plurality of diagonal cross pieces; and a plurality of cylindrical members, each cylindrical member inserted within a respective triangular space of the plurality of triangular spaces and in contact with cross pieces of the plurality of cross pieces defining the respective triangular space.

* * * * *